US005682866A

United States Patent [19]

Shimizu et al.

[11] Patent Number: 5,682,866

[45] Date of Patent: Nov. 4, 1997

[54] AIR-FUEL RATIO CONTROL SYSTEM FOR INTERNAL COMBUSTION ENGINES

[75] Inventors: Daisuke Shimizu; Hiroshi Mifune; Kenji Nakano, all of Wako, Japan

[73] Assignee: Honda Giken Kogyo Kabushiki Kaisha, Tokyo, Japan

[21] Appl. No.: 704,878

[22] Filed: Aug. 30, 1996

[30] Foreign Application Priority Data

Sep. 1, 1995 [JP] Japan ..... 7-247013

[51] Int. Cl.[6] ..... F02D 41/14

[52] U.S. Cl. ..... 123/674

[58] Field of Search ..... 123/674, 675

[56] References Cited

U.S. PATENT DOCUMENTS

| | | | |
|---|---|---|---|
| 4,130,095 | 12/1978 | Bowler et al. | 123/675 |
| 4,677,559 | 6/1987 | Van Bruck | 123/674 X |
| 4,977,881 | 12/1990 | Abe et al. | 123/674 |

FOREIGN PATENT DOCUMENTS

| | | |
|---|---|---|
| 58-59330 | 4/1983 | Japan . |
| 58-72631 | 4/1983 | Japan . |
| 59-9742 | 3/1984 | Japan . |

*Primary Examiner*—Tony M. Argenbright

*Attorney, Agent, or Firm*—Nikaido, Marmelstein, Murray & Oram LLP

[57] ABSTRACT

An air-fuel ratio control system for an internal combustion engine has an air-fuel ratio sensor arranged in the exhaust system of the engine, for detecting the air-fuel ratio of exhaust gases emitted from the engine, and various engine operating parameter sensors for detecting operating conditions of the engine. An ECU controls the air-fuel ratio of an air-fuel mixture to be supplied to the engine to a desired air-fuel ratio in a feedback manner responsive to an output from the air-fuel ratio sensor. A first learned value for correcting the desired air-fuel ratio is calculated based on the feedback control when the engine is detected to be in a first predetermined operating condition, and a second learned value for correcting the desired air-fuel ratio when the engine is detected to be in a second predetermined engine operating condition. The air-fuel ratio of the air-fuel mixture is controlled to a value leaner than a stoichiometric value, by using the first learned value. The first learned value is learned again when the difference between the first and the second learned values is larger than a predetermined re-learning-determining threshold value.

5 Claims, 13 Drawing Sheets

FUEL INJECTION VALVE
THREE-WAY CATALYST
INTERNAL COMBUSTION ENGINE
CYL
TDC
CRK
TW
TA
PBA
θ TH
O2
INPUT CIRCUIT
C P U
MEMORY MEANS
OUTPUT CIRCUIT
ECU
V
GP
1
2
3
4
5
5a
5b
5c
5d
6
7
8
9
10
11
12
13
14
15
16
20
21
31
32
40

*FIG.3*

| | CREF0 | CREF1 | CREFAF |
|---|---|---|---|
| TW<TWREF (LOW TW) OR KEVAPO<KEVAPL (LARGE PURGING INFLUENCE) | CREF0A | CREF1A | CREFAFA |
| TW>TWREF (HIGH TW) AND KEVAPO>KEVAPL (SMALL PURGING INFLUENCE) | CREF0B | CREF1B | CREFAFB |

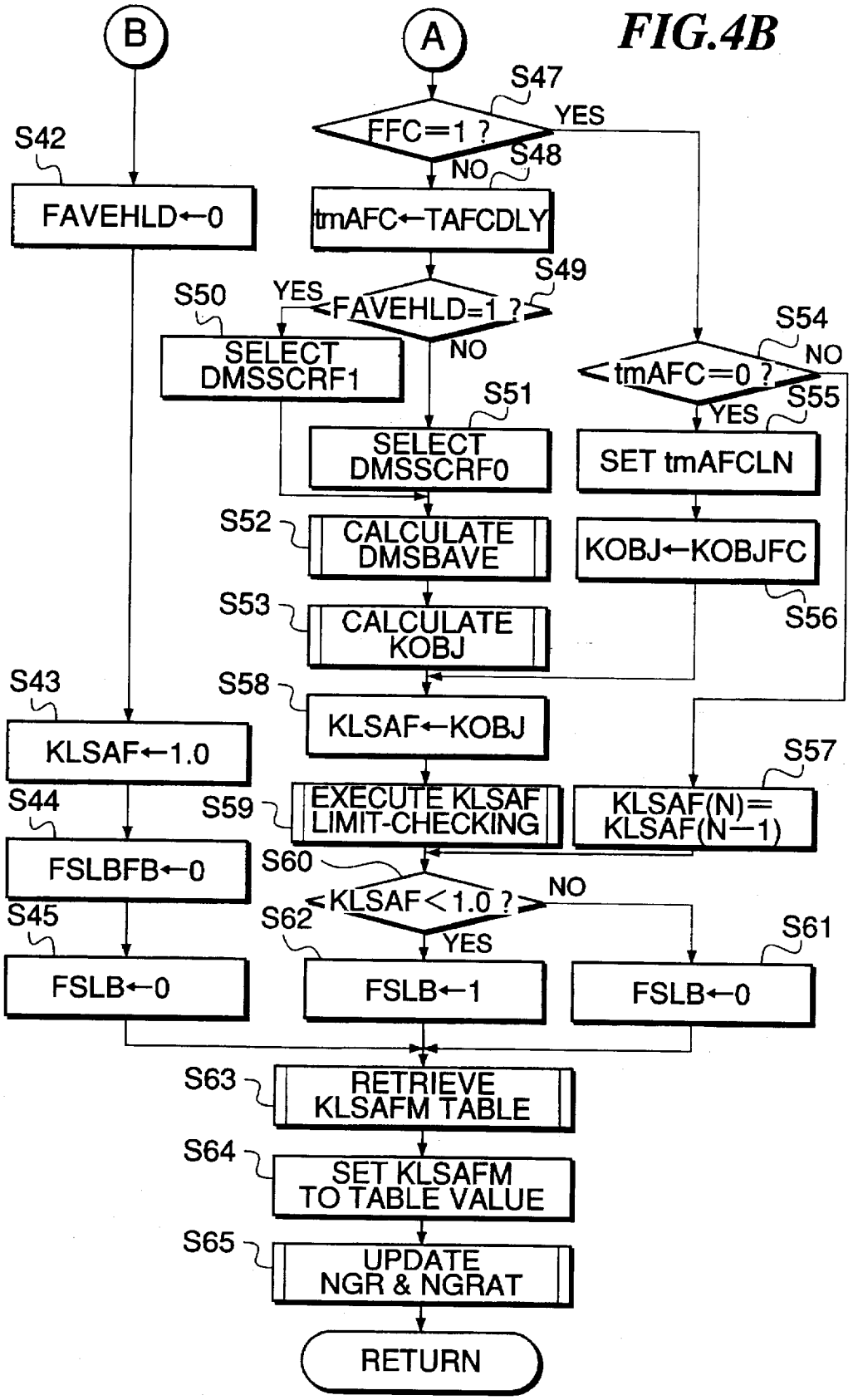
FIG.4B
B
A
S47
FFC=1 ?
YES
NO
S48
S42
FAVEHLD←0
tmAFC←TAFCDLY
S49
S50
YES
FAVEHLD=1 ?
NO
SELECT DMSSCRF1
S54
tmAFC=0 ?
NO
YES
S55
S51
SELECT DMSSCRF0
SET tmAFCLN
S52
CALCULATE DMSBAVE
KOBJ←KOBJFC
S53
CALCULATE KOBJ
S56
S43
S58
KLSAF←KOBJ
KLSAF←1.0
S57
S44
S59
EXECUTE KLSAF LIMIT-CHECKING
KLSAF(N)= KLSAF(N−1)
FSLBFB←0
S60
KLSAF<1.0 ?
NO
S45
S62
YES
S61
FSLB←0
FSLB←1
FSLB←0
S63
RETRIEVE KLSAFM TABLE
S64
SET KLSAFM TO TABLE VALUE
S65
UPDATE NGR & NGRAT
RETURN FIB.7B
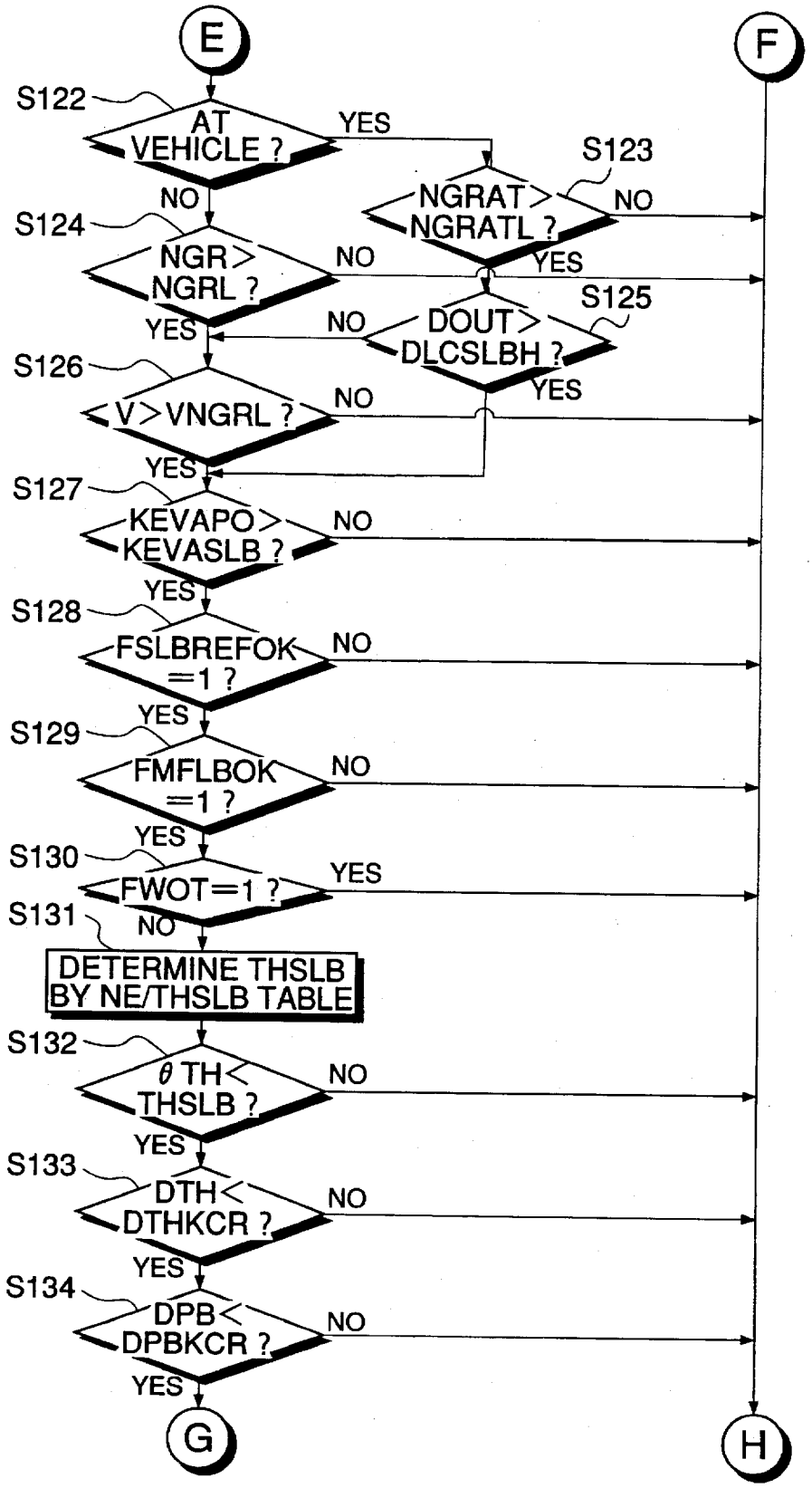

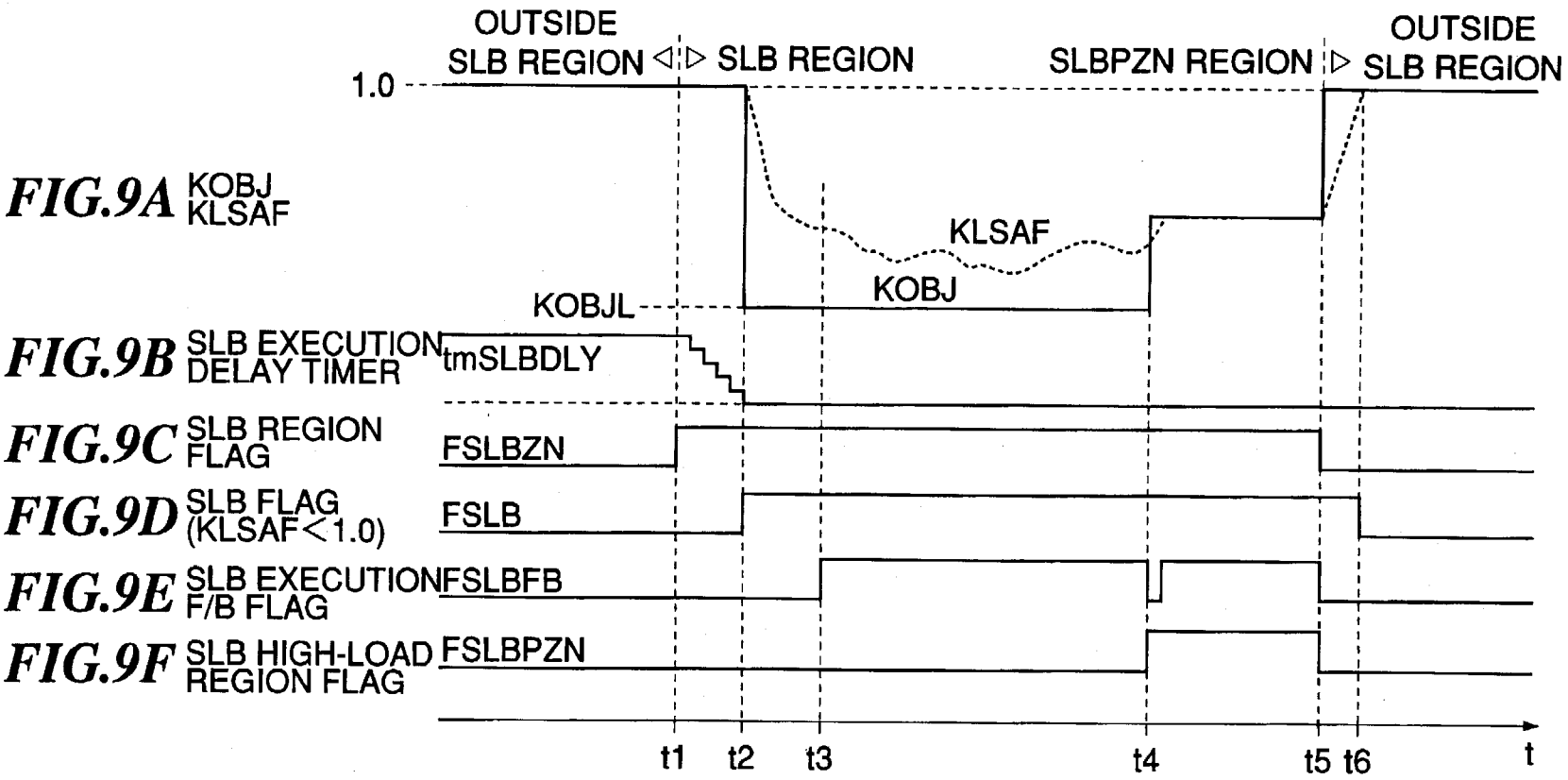
OUTSIDE SLB REGION
SLBPZN REGION
SLB REGION
OUTSIDE SLB REGION
1.0
KLSAF
KOBJ
KOBJL
tmSLBDLY
FSLBZN
FSLB
FSLBFB
FSLBPZN
t1
t2
t3
t4
t5
t6
t
FIG.9A KOBJ KLSAF
FIG.9B SLB EXECUTION DELAY TIMER
FIG.9C SLB REGION FLAG
FIG.9D SLB FLAG (KLSAF<1.0)
FIG.9E SLB EXECUTION F/B FLAG
FIG.9F SLB HIGH-LOAD REGION FLAG

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system of this kind, which controls the air-fuel ratio of an air-fuel mixture to be supplied to the engine in a feedback manner in response to an output from an air-fuel ratio sensor arranged in the exhaust system of the engine, and also carries out so-called lean-burn control by using a learned value calculated during the feedback control of the air-fuel ratio.

2. Prior Art

To curtail fuel consumption by an internal combustion engine, a so-called lean-burn control method is widely employed, which controls the air-fuel ratio of an air-fuel mixture to be supplied to the engine to a value leaner than a stoichiometric air-fuel ratio. The conventional lean-burn control method includes the following methods:

(1) A method of feedback-controlling the air-fuel ratio by using a linear output air-fuel ratio sensor which can be used to detect the air-fuel ratio on a lean side of a stoichiometric value, as is known from Japanese Laid-Open Patent Publication (Kokai) No. 58-59330;

(2) A method of detecting a combustion state of an internal combustion engine, based on fluctuations in the rotational speed of the engine, combustion pressure of the same, etc., and controlling the air-fuel ratio to a leaner limit value in a feedback manner responsive to the detected combustion state, as is known from Japanese Patent Publication (Kokoku) No. 59-9742; and (3) A method of controlling the air-fuel ratio in an open-loop control manner by multiplying a basic value of the fuel supply amount determined based on load on the engine and the rotational speed of the engine, by a fixed leaning coefficient, as is known from Japanese Laid-Open Patent Publication (Kokai) No. 58-72631.

The methods (2) and (3) do not employ a linear-output air-fuel ratio sensor but employ a binary output type air-fuel ratio sensor whose output sharply changes as the air-fuel ratio changes across a stoichiometric value, to feedback-control the air-fuel ratio by the use of an air-fuel ratio correction coefficient determined in response to an output from the air-fuel ratio sensor when the engine is operating in a predetermined condition after completion of the warming-up of the engine. Further, according to the methods (2) and (3), during the feedback control, a learned value of the air-fuel ratio correction coefficient is calculated and used for determination of a fuel supply amount during execution of the lean-burn control, to thereby correct deviation of the basic value of the fuel supply amount from a proper value, which makes it possible to achieve optimal lean-burn control regardless of variations in individual sensors employed which are attributable to mass production of engine component parts and sensors.

According to the above conventional methods, however, the learned value of the air-fuel ratio correction coefficient is calculated when the engine is in the predetermined operating condition after completion of the warming-up of the engine, and the calculated learned value is applied so long as the engine operation is continued. As a result, the following inconveniences exist:

That is, for example, if the methods are applied to an internal combustion engine provided with an evaporative fuel-processing system which adsorbs evaporative fuel and supplies or purges the same to the intake system of the engine, the purging can cause a change in the central value of the air-fuel ratio correction coefficient depending upon a change in the degree of purging, and accordingly the fuel supply amount is corrected according to the change in the degree of purging. As a result, the learned value is deviated from the optimal value, thereby degrading the fuel consumption and the drivability.

Further, when a vehicle in which the engine is installed moves to a place which is different in altitude from a place at which the learned value was calculated, the central value of the air-fuel ratio correction coefficient is changed due to a change in the atmospheric pressure, whereby the fuel supply amount is corrected according to the change in the atmospheric pressure. Accordingly, on this occasion as well, the learned value is deviated from the optimal value, also resulting in degraded fuel consumption and driveability.

SUMMARY OF THE INVENTION

It is the object of the invention to provide an air-fuel ratio control system for internal combustion engines, which is capable of performing lean-burn control by using an optimal learned value irrespective of the influence of purging or change in altitude.

To attain the above object, the present invention provides an air-fuel ratio control system for an internal combustion engine having an exhaust system, comprising:

air-fuel ratio-detecting means arranged in the exhaust system, for detecting an air-fuel ratio of exhaust gases emitted from the engine;

operating condition-detecting means for detecting operating conditions of the engine;

feedback control means for controlling an air-fuel ratio of an air-fuel mixture to be supplied to the engine to a desired air-fuel ratio in a feedback manner responsive to an output from the air-fuel ratio-detecting means;

first learned value-calculating means for calculating a first learned value for correcting the desired air-fuel ratio, based on an output from the feedback control means, when the engine is detected to be in a first predetermined operating condition by the operating condition-detecting means;

second learned value-calculating means for calculating a second learned value for correcting the desired air-fuel ratio, based on the output from the feedback control means, when the engine is detected to be in a second predetermined engine operating condition by the operating condition-detecting means;

leaning control means for controlling the air-fuel ratio of the air-fuel mixture to a value leaner than a stoichiometric value, by using the first learned value; and re-learning means for re-learning the first learned value when a difference between the first learned value and the second learned value is larger than a predetermined re-learning-determining threshold value.

Preferably, the first predetermined operating condition of the engine is a condition after completion of warming-up of the engine.

Also preferably, the second predetermined operating condition of the engine is a condition other than idling of the engine, the second learned value-calculating means calculating the second learned value before completion of calculation of the first learned value by the first learned value-calculating means.

More preferably, the air-fuel ratio control system includes inhibiting means for inhibiting relearning of the first learned value when the difference is larger than a predetermined inhibition-determining threshold value immediately after completion of learning of the first learned value.

The above and other objects, features, and advantages of the invention will become more apparent from the following detailed description taken in conjunction with the accompanying drawings.

BRIEF DESCRIPTION OF THE DRAWINGS

FIG. 3 is a graph useful in explaining setting of parameters employed in the FIG. 2 processing;

FIG. 4B is a continued part of the FIG. 4A flowchart;

FIG. 7B is a continued part of the FIG. 7A flowchart;

FIGS. 9A to 9F collectively form a timing chart showing the relationship between operations of a timer and flags and changes in control parameter values, wherein:

FIG. 9A shows changes in the desired air-fuel ratio KOBJ and a lean-burn control correction coefficient KLSAF;

FIG. 9B shows an operation of an SLB execution delay timer tmSLBDLY;

FIG. 9C shows changes in an SLB region flag FSLBZN;

FIG. 9D shows changes in an SLB execution flag FSLB;

FIG. 9E shows changes in an SLBF/B flag FSLBFB; and

FIG. 9F shows changes in an SLB high-load region flag FSLBPZN; and

DETAILED DESCRIPTION

The invention will now be described in detail with reference to the drawings showing an embodiment thereof.

Figure 1:
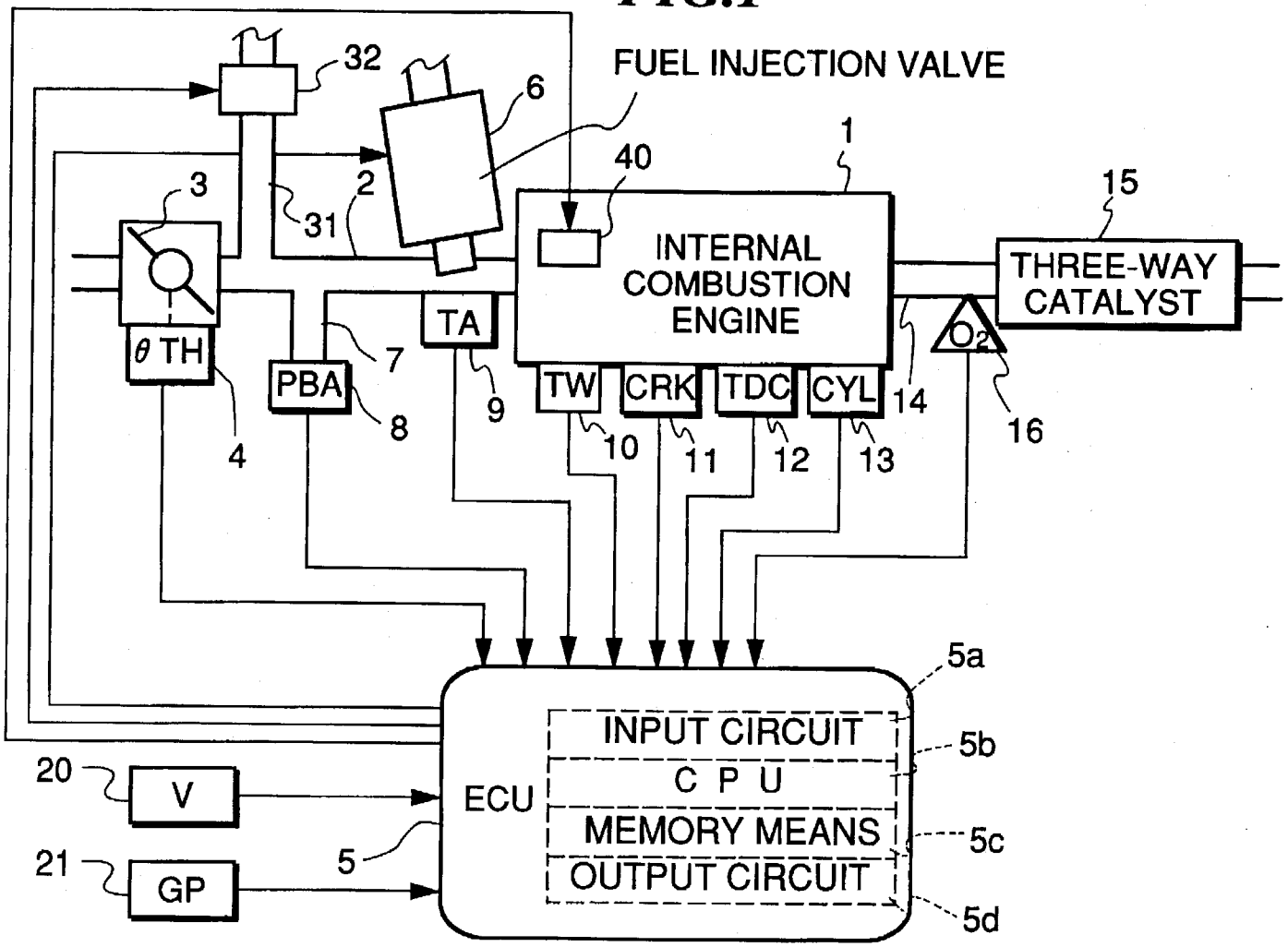
FIG. 1 is a block diagram showing the whole arrangement of an internal combustion engine incorporating an air-fuel ratio control system therefor, according to an embodiment of the invention.

Referring first to FIG. 1, there is shown the whole arrangement of an internal combustion engine (hereinafter referred to as "the engine") 1 incorporating an air-fuel ratio control system therefor, according to an embodiment of the invention. Connected to the cylinder block of the engine 1 is an intake pipe 2 in which is arranged a throttle valve 3. A throttle valve opening (θTH) sensor 4 is connected to the throttle valve 3, for generating an electric signal indicative of the sensed throttle valve opening θTH and supplying the same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3 and slightly upstream of respective corresponding intake valves, not shown. The fuel injection valves 6 are connected to a fuel pump, not shown, and electrically connected to the ECU 5 to have their valve opening periods controlled by signals therefrom.

On the other hand, an intake pipe absolute pressure (PBA) sensor 8 is provided in communication with the interior of the intake pipe 2 via a conduit 7 opening into the intake pipe 2 at a location immediately downstream of the throttle valve 3, for supplying an electric signal indicative of the sensed absolute pressure PBA within the intake pipe 2 to the ECU 5. An intake air temperature (TA) sensor 9 is inserted into the intake pipe 2 at a location downstream of the PBA sensor 8 for supplying an electric signal indicative of the sensed intake air temperature TA to the ECU 5.

An engine coolant temperature (TW) sensor 10, which may be formed of a thermistor or the like, is mounted in the cylinder block of the engine 1, for supplying an electric signal indicative of the sensed engine coolant temperature TW to the ECU 5.

A cylinder-discriminating sensor (hereinafter referred to as "the CYL sensor") 13, a TDC sensor 12, and a crank angle sensor (hereinafter referred to as "the CRK sensor") 11 are arranged in facing relation to a camshaft or a crankshaft of the engine 1, neither of which is shown. The CYL sensor 13 generates a signal pulse (hereinafter referred to as "a CYL signal pulse") at a predetermined crank angle position of a particular cylinder of the engine 1, and the TDC sensor 12 generates a signal pulse (hereinafter referred to as "a TDC signal pulse") at one of predetermined crank angle positions (e.g. whenever the crankshaft rotates through 180 degrees when the engine is of a four-cylinder type) which corresponds to a predetermined crank angle before a top dead point (TDC) of each cylinder corresponding to the start of the intake stroke of the cylinder. The CRK sensor 11 generates a signal pulse (hereinafter referred to as "a CRK signal pulse") at each of predetermined crank angle positions whenever the crankshaft rotates through a predetermined angle (e.g. 30 degrees) with a predetermined repetition period shorter than the repetition period of TDC signal pulses. The CYL signal pulse, the TDC signal pulse, and the CRK signal pulse are supplied to the ECU 5.

A three-way catalyst 15 is arranged in an exhaust pipe 14 connected to the cylinder block of the engine 1, for purifying noxious components present in exhaust gases, such as HC, CO, and NOx. An oxygen concentration sensor (hereinafter referred to as "the O2 sensor") 16 as an air-fuel ratio sensor is mounted in the exhaust pipe 14 at a location upstream of the three-way catalyst 15, for sensing the concentration of oxygen present in exhaust gases emitted from the engine 1 and supplying an electric signal indicative of the sensed oxygen concentration to the ECU 5.

Further connected to the ECU 5 are a vehicle speed (V) sensor 20 for detecting the traveling speed V of the vehicle, a gear ratio sensor 21 for detecting reduction gear ratio (shift position) of a transmission, not shown, of the vehicle, etc., for supplying respective signals indicative of the detected parameters to the ECU 5. Alternatively, the reduction gear ratio may be detected based on the vehicle speed V and the engine rotational speed NE.

Connected to the intake pipe 2 via a passage 31 is a canister, not shown, for adsorbing evaporative fuel generated in a fuel tank, not shown. A purge control valve 32 is arranged across the passage 31, which is electrically connected to the ECU 5 to have its valving operation controlled by a signal from the ECU 5. The purge control valve 32 is opened when the engine 1 is in a predetermined operating condition to supply evaporative fuel stored in the canister into the intake pipe 2.

The engine 1 has a valve timing changeover mechanism 40 which can change valve timing and valve lift of the intake valves to three valve timing levels, i.e. a high-speed valve timing suitable for operation of the engine in a high rotational speed region, an intermediate-speed valve timing suitable for operation of the engine in an intermediate rotational speed region, and a low-speed valve timing suitable for operation of the engine in a high rotational speed region. More specifically, when the high-speed valve timing is selected, two intake valves provided for each cylinder are operated such that the valve opening period and the valve lift are suitable for a relatively high engine rotational speed, and when the intermediate-speed valve timing is selected, the two intake valves are operated such that the valve opening period and the valve lift are suitable for a relatively low engine rotational speed. Further, when the low-speed valve timing is selected, one of the two intake valves is operated similarly to the intermediate-speed valve timing in valve opening period and valve lift, and the other valve is operated with a shorter valve opening period and a smaller valve lift. By virtue of this setting, when the low-speed valve timing is selected, even if the air-fuel ratio is controlled to a value leaner than the stoichiometric value, stable combustion of the engine can be ensured.

The valve timing changeover mechanism 40 controls changeover of the valve timing by oil pressure, and an electromagnetic valve for changing the oil pressure and an oil pressure sensor, neither of which is shown, are electrically connected to the ECU 5. A signal indicative of the sensed value from the oil pressure sensor is supplied to the ECU 5, for controlling the operation of the electromagnetic valve, to thereby control the changeover of the valve timing.

The ECU 5 is comprised of an input circuit 5*a* having the functions of shaping the waveforms of input signals from various sensors, shifting the voltage levels of sensor output signals to a predetermined level, converting analog signals from analog-output sensors to digital signals, and so forth, a central processing unit (hereinafter referred to as "the CPU") 5*b*, a memory device 5*c* storing various operational programs which are executed by the CPU 5*b*, and for storing results of calculations therefrom, etc., and an output circuit 5*d* which outputs driving signals to the fuel injection valves 6, the electromagnetic valve of the valve timing changeover mechanism 40, etc.

The CPU 5*b* operates in response to the above-mentioned signals from the sensors to determine various operating conditions in which the engine 1 is operating, such as an air-fuel ratio feedback control region in which the air-fuel ratio of a mixture supplied to the engine 1 is controlled in response to the detected oxygen concentration in exhaust gases, and open-loop control regions other than the air-fuel ratio feedback control region, and calculates, based upon the determined operating conditions, the valve opening periods or fuel injection periods TOUT over which the fuel injection valves 6 are to be opened in synchronism with generation of TDC signal pulses, by the use of the following equation (1),:

$$TOUT=TI\times KLSAFM\times KO2\times KEVAPO\times K1+K2 \quad (1)$$

where TI represents a basic value of the fuel injection period TOUT, which is determined in accordance with the engine rotational speed NE and the intake pipe absolute pressure PBA. A TI map for use in determining the TI value is stored in the memory device 5*c*.

KLSAFM represents a modified lean-burn correction coefficient obtained by effecting a volumetric efficiency correction on a lean-burn correction coefficient KLSAF, which is set to a value smaller than 1.0 when the engine 1 and the vehicle are in respective predetermined operating conditions. A manner of determining the modified lean-burn correction coefficient KLSAFM will be described in detail hereinafter with reference to FIG. 4A.

KO2 represents an air-fuel ratio feedback control correction coefficient which is determined in response to a value of the oxygen concentration in the exhaust gases detected by the 02 sensor 16 such that the detected air-fuel ratio (oxygen concentration) becomes equal to the stoichiometric value during air-fuel ratio feedback control, while it is set to respective predetermined or learned values (KREF0, KREF1) while the engine is in the open-loop control regions. Further, the correction coefficient KO2 is set to a learned value KREFAF during lean-burn control.

KEVAPO represents an evaporative fuel-dependent correction coefficient for compensating for an influence of evaporative fuel caused by purging. The KEVAPO value is set to 1.0 when purging is not carried out, while it is set to a value between 0 to 1.0 when purging is carried out. A smaller value of the evaporative fuel-dependent correction coefficient KEVAPO reflects that the influence of purging is larger.

K1 and K2 represent other correction coefficients and correction variables, respectively, which are calculated based on various engine operating parameter signals to such values as to optimize characteristics of the engine such as fuel consumption and drivability depending on operating conditions of the engine.

Next, description will be made of control processing executed by the CPU 5*b*.

Figure 2:
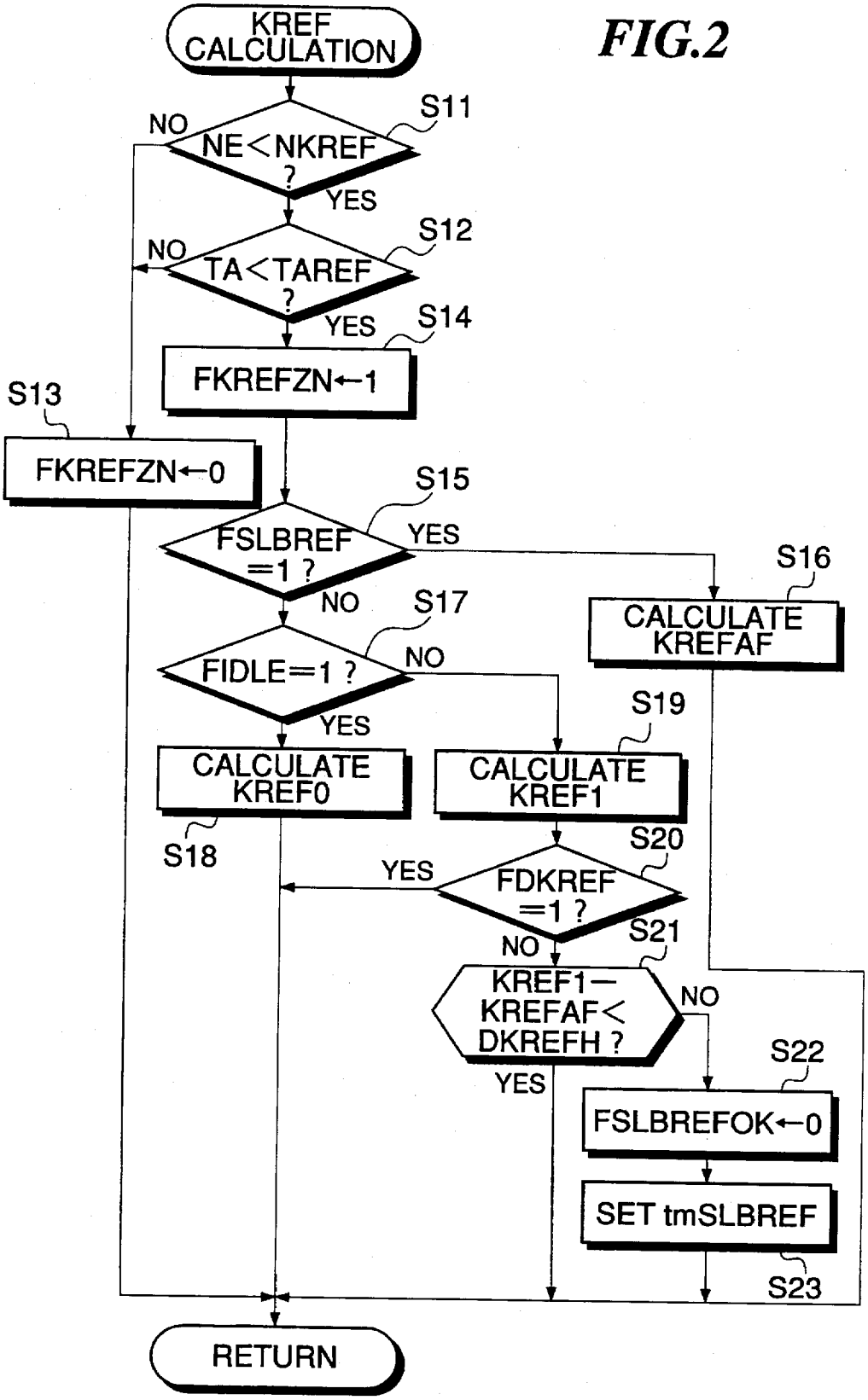
FIG. 2 is a flowchart showing a program for calculating learned values of an air-fuel ratio correction coefficient.

FIG. 2 shows a program for calculating learned values KREF0, KREF1 and KREFAF of the air-fuel ratio correction coefficient KO2, which is executed in synchronism with generation of TDC signal pulses.

First, at a step S11, it is determined whether or not the engine rotational speed NE is lower than a predetermined value NKREF (e.g. 4000 rpm). If NE<NKREF holds, it is determined at a step S12 whether or not the intake air temperature TA is lower than a predetermined value TAREF (e.g. 64° C.). If either NE≧NKREF or TA≧TAREF holds, a KO2-learning region flag FKREFZN is set to "0" at a step S13, followed by terminating the present routine. The KO2-learning region flag FKREFZN, when set to "1", indicates that the engine is operating in an air-fuel ratio correction coefficient KO2-learning region.

On the other hand, if NE<NKREF and TA<TAREF both hold, the KO2-learning region flag FKREFZN is set to "1" at a step S14, and then it is determined at a step S15 whether or not a KREFAF-learning region flag FSLBREF is set to "1". The KREFAF-learning region flag FSLBREF, when set to "1", indicates that the engine is operating in a lean control learned value KREFAF-calculating region (hereinafter referred to as "the KREFAF-learning region"), which is applied during lean-burn control, as mentioned above. The flag FSLBREF is set by a processing shown in FIGS. 6A and 6B, described hereinafter.

If the answer is affirmative (YES), i.e. if the engine is operating in the KREFAF-learning region, the learned value KREFAF of the air-fuel ratio correction coefficient KO2 is calculated at a step S16, by the use of the following equation (2), followed by terminating the present routine:

$$KREFAF(N)=CREFAF\times KO2/A+(A-CREFAF)\times KREFAF(N-1)/A \quad (2)$$

where (N) and (N−1) indicate that values with these suffixes are obtained in the present loop and the immediately preceding loop, respectively. Further, A represents a constant which is set, e.g. to 10,000 (hexadecimal), CREFAF an averaging coefficient for calculating the lean control learned value KREFAF, which is set to a value between 1 and the value A, and KO2 a value of the air-fuel ratio correction coefficient obtained immediately after execution of proportional control of the air-fuel ratio control, i.e. immediately after a proportional term is added or subtracted to or from a last value of the KO2 value upon inversion of an output from the O2 sensor 16.

If FSLBREF=0 holds at the step S15, i.e. if the engine is not operating in the KREFAF-learning region, it is determined at a step S17 whether or not an idling flag FIDLE which, when set to "1", indicates that the engine is idling, is set to "1". If the engine is idling, the idling learned value KREF0 is calculated at a step S18, by the use of the following equation (3), followed by terminating the present routine:

$$KREF0(N)=CREF0\times KO2/A+(A-CREF0)\times KREF0(N-1)/A \quad (3)$$

where CREF0 represents an averaging coefficient for calculating the idling learned value KREF0, which is set to a value between 1 and the value A.

This idling learned value KREF0 is applied when the engine is in one or more of the open-loop control regions as mentioned before, but also applied as an initial value of the air-fuel ratio correction coefficient KO2 when the engine enters an idling region within the air-fuel ratio feedback control region.

If FIDLE=0 holds at the step S17, which means that the engine is not idling (hereinafter referred to as "the off-idling state"), an off-idling learned value KREF1 is calculated at a step S19, by the use of the following equation (4):

$$KREF1(N)=CREF1\times KO2/A+(A-CREF1)\times KREF1(N-1)/A \quad (4)$$

where CREF1 represents an averaging coefficient for calculating the off-idling learned value KREF1, which is set to a value between 1 and the value A. The averaging coefficients CREFAF, CREF0 and CREF1 are set, as shown in FIG. 3, according to the engine coolant temperature TW and the evaporative fuel-dependent correction coefficient KEVAPO. In the figure, the averaging coefficients are each set such that a value in the lower row (where TW>TWREF and KEVAPO>KEVAPL hold) is larger than a value in the upper row.

This off-idling learned value KREF1 is applied when the engine is in one or more of the open-loop control regions as mentioned before, but also applied as an initial value of the air-fuel ratio correction coefficient KO2 when the engine enters an off-idling region within the air-fuel ratio feedback control region.

At the following step S20, it is determined whether or not an erroneous learning flag FDKREF which, when set to "1", indicates that the off-idling learned value KREF1 is unsuitable (erroneously learned) is set to "1". If FDKREF=1 holds, which means that the KREF1 value is erroneously learned, the program is immediately terminated without executing a step S21.

On the other hand, if the answer to the question of the step S20 is negative (NO), it is determined whether or not a difference (KREF1−KREFAF) between the off-idling learned value KREF1 and the lean control learned value KREFAF is smaller than a first predetermined difference DKREFH (e.g. 0.04), at a step S21. If (KREF1−KREFAF) <DKREFH holds, the program is immediately terminated. On the other hand, if (KREF1−KREFAF)≧DKREFH holds, a learning completion flag FSLBREFOK which, when set to "1", indicates that the calculation (learning) of the lean control learned value KREFAF has been completed, is set to "0" at a step S22. Then, a down-counting timer tmSLBREF is set to a predetermined learning time period TSLBREF and started at a step S23, followed by terminating the present routine. The timer tmSLBREF measures a learning time period TSLBREF over which the lean control learned value KREFAF is to be learned, which will be referred to in the processing of FIG. 6B.

By the above steps S21 to S23, if the difference between the KREF1 value and the KREFAF value is larger than the predetermined difference DKREFH, the lean control learned value KREFAF is learned again, and as a result, the KREFAF value can be updated to a more suitable value to compensate for deviation of its value from the optimal value ascribable to the influence of purging or change in the altitude, to thereby prevent degradation of the fuel consumption and the drivability during the lean-burn control.

Figure 4A:
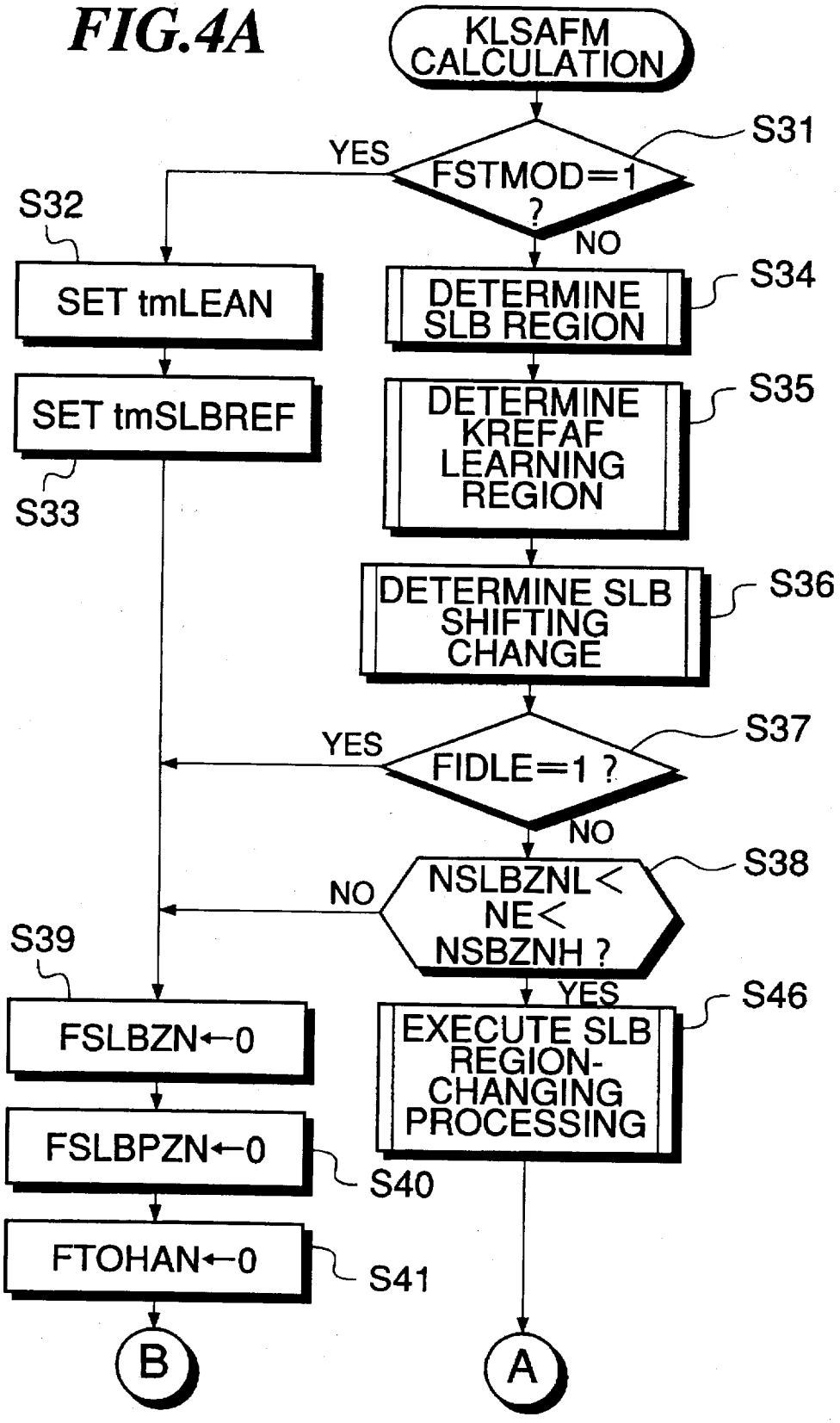
FIG. 4A is a flowchart showing a program for calculating a modified lean-burn control correction coefficient KLSAFM.

FIGS. 4A and 4B show a program for calculating the modified lean-burn correction coefficient KLSAFM, which is executed in synchronism with generation of TDC signal pulses.

First, at a step S31, it is determined whether or not a cranking flag FSTMOD which, when set to "1", indicates that the engine is being cranked or in starting mode, is set to "1". If the engine is being cranked, the following processings (1) to (5) are executed, followed by the program proceeding to a step S63:

(1) A down-counting timer tmLEAN is set to an after-cranking lean-burn-inhibiting time period TLEAN and started at a step S32;

(2) The down-counting timer tmSLBREF for measuring the learning time period of the lean control learned value KREFAF is set to the predetermined learning time period TSLBREF and started at a step S33;

(3) An SLB region flag FSLBZN which, when set to "1", indicates that the engine is operating in a region where the lean-burn control can be carried out (hereinafter referred to as "the SLB region"), an SLB high-load region flag FSLBPZN which, when set to "1", indicates that the engine is operating in a high-load region within the SLB region, and a climbing flag FTOHAN which, when set to "1", indicates that the vehicle is traveling on an uphill road, are all set to "0", at steps S39, S40 and S41, respectively;

(4) A combustion state flag FAVEHLD which, when set to "1", indicates that the combustion state of the engine is unstable, an SLBF/B flag FSLBFB which, when set to "1", indicates that the lean-burn feedback control is being executed, and an SLB execution flag which is set to "1" to indicate that the lean-burn control is being executed, are all set to "0" at steps S42, S44 and S45, respectively; and (5) The lean-burn correction coefficient KLSAF is set to 1.0 at a step S43.

On the other hand, if it is determined at the step S31 that the engine is not in the cranking mode, the program proceeds to a step S34, wherein an SLB region-determining processing, not shown, is executed. In this processing, one of region tables is selected which are provided with threshold values for determining whether or not the lean-burn control is to be executed, according to the vehicle speed V and vehicle acceleration. In each of the region tables, a predetermined value PBATH of the intake pipe absolute pressure PBA is set as the threshold value according to the engine rotational speed NE.

At the following step S35, a KREFAF learning region-determining processing of FIGS. 6A and 6B, described hereinafter, is executed, and then an SLB shift change-determining processing is executed at a step S36. In the SLB shift change-determining processing, shift change (change in the reduction gear ratio) is detected, and if shifting-down of the reduction gear ratio is detected, a down-counting timer tmSFTDLY for measuring a delay time period after shifting-down is set to a predetermined time period TSFTDLY and started. On the other hand, if shifting-up of the reduction gear ratio is detected, the timer tmSFTDLY is set to "0".

At the following step S37, it is determined whether or not the idling flag FIDLE is set to "1". If FIDLE=0 holds, which means that the engine is not idling, then it is determined at a step S38 whether or not the engine rotational speed NE falls within a range between predetermined upper and lower limit values NSLBZNH and NSLBZNL (e.g. 4000 rpm and 900 rpm, respectively). If FIDLE=1 holds, which means that the engine is idling, or if NE≦NSLBZNL or NE≧NSLBZNH holds, the program proceeds to the step S39.

On the other hand, if NSLBZNL<NE<NSLBZNH holds, the program proceeds to a step S46, wherein an SLB region-changing processing is executed. In this processing, the SLB high-load region flag FSLBPZN and the climbing flag FTOHAN are set according to the reduction gear ratio, the intake pipe absolute pressure PBA, a rate of variation in the vehicle speed V (acceleration), etc. On this occasion, the region table selected in the SLB region processing at the step S34 is used At a step S47, it is determined whether or not a fuel cut flag FFC which, when set to "1", indicates that the engine is under fuel cut, is set to "1". If FFC=0 holds, which means that the engine is not under fuel cut, a down-counting timer tmAFC is set to a predetermined delay time period TAFCDLY to be counted after the engine enters the fuel cut state, and started at a step S48. Then, it is determined whether or not the combustion state flag FAVEHLD is set to "1" at a step S49. If FAVEHLD=0 holds, which means that the combustion state is stable, an averaging coefficient DMSSCRF to be used in a DMSBAVE-calculating processing at a step S52 is set to a first value DMSSCRF0 at a step S51. On the other hand, if FAVEHLD=1 holds, which means that the combustion state is unstable, the DMSSCRF value is set to a second value DMSSCRF1 which is smaller than the first value DMSSCRF0, at a step S50, and then the program proceeds to the step S52. By virtue of this setting, when the combustion state is unstable, the contribution degree of a present value of a variation rate DMSSLB in the engine rotational speed is lowered. The combustion state is determined to be stable when the variation rate DMSSLB is lower than a predetermined value.

At the step S52, the above-mentioned averaging coefficient DMSSCRF is applied to the following equation (5) to calculate an average value DMSBAVE of the variation rate DMSSLB in the engine rotational speed:

$$DMSBAVE(N)=DMSSCRF\times DMSSLB/A+(A-DMSSCRF)\times DMSBAVE(N-1)/A \quad (5)$$

where the variation rate DMSSLB in the engine rotational speed is calculated based on time intervals CRME of generation of CRK signal pulses. A smaller value of the variation rate DMSSLB means that the combustion state of the engine is more stable.

At the following step S53, a desired air-fuel ratio KOBJ is calculated. This calculation will be described hereinafter with reference to FIGS. 7A to 7C. The KOBJ value is proportional to the reciprocal of the air-fuel ratio A/F and defined to be an equivalent ratio of the air-fuel ratio which is set to 1.0 when the air-fuel ratio assumes the stoichiometric value. Therefore, the KOBJ value is set to a value smaller than 1.0 when the lean-burn control is being executed.

Then, at a step S58, the lean-burn correction coefficient KLSAF is set to the KOBJ value calculated at the step S53 (or at a step S56, referred to hereinafter), and then a KLSAF limit-checking is executed at a step S59, followed by the program proceeding to a step S60. In the KLSAF limit-checking, when the engine is operating in a high-load region or a region where the engine load is being increased at a high rate, the lean burn correction coefficient KLSAF is progressively increased. On the other hand, when the engine is not operating in the high-load region or is operating in a region where the engine load is being increased at a low rate and at the same time KLSAF>KOBJ holds, the KLSAF value is feedback-controlled to change according to the variation rate DMSSLB in the engine rotational speed.

Referring again to the step S47, if FFC=1 holds, i.e. if the engine is under fuel cut, it is determined at a step S54 whether or not the count value of the timer tmAFC set at the step S48 is equal to "0". If tmAFC>0 holds, the lean-burn correction coefficient KLSAF is kept at its immediately preceding value at a step S57, followed by the program proceeding to the step S60. When tmAFC=0 holds thereafter, a down-counting timer tmAFCLN, referred to in the processing of FIG. 7C, described hereinafter, is set to a predetermined time period TAFCLN to be counted after completion of fuel cut and started at a step S55. Then, the desired air-fuel ratio KOBJ is set to a predetermined value KOBJFC suitable for a fuel cut state at a step S56, followed by the program proceeding to the step S58.

At the step S60, it is determined whether or not the calculated KLSAF value is smaller than 1.0. If KLSAF<1.0 holds, the SLB execution flag FSLB is set to "1" at a step S62, whereas if KLSAF=1.0 holds, the flag FSLB is set to 0 at a step S61, followed by the program proceeding to a step S63.

At the step S60, it is determined whether or not the calculated KLSAF value is smaller than 1.0. If KLSAF<1.0 holds, the SLB execution flag FSLB is set to "1" at a step S62, whereas if KLSAF=1 holds, the flag FSLB is set to "0" at a step S61, followed by the program proceeding to the step S63.

Figure 5:
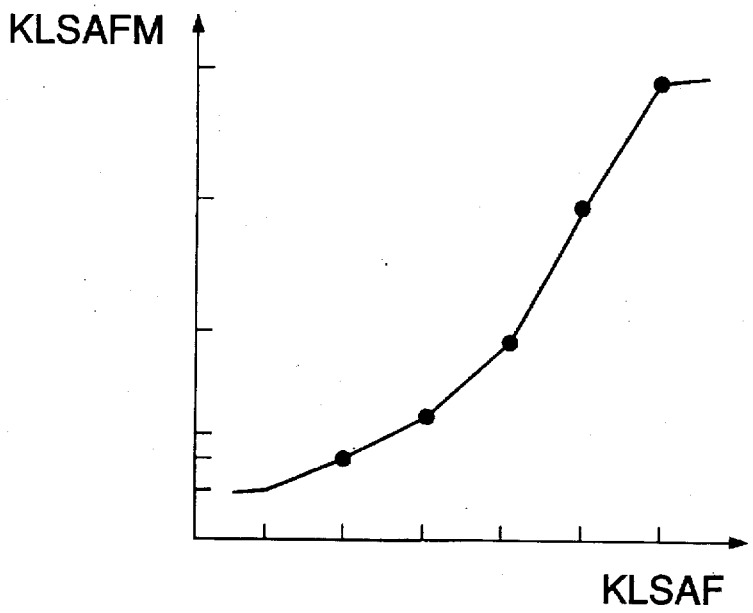
FIG. 5 shows a table which is used for determining the modified lean-burn correction coefficient KLSAFM.

At the step S63, a KLSAFM table, shown in FIG. 5, is retrieved based on the KLSAF value, for determining the modified lean-burn correction coefficient KLSAFM at a step S64, to thereby execute the volumetric efficiency correction. Then, parameters NGR and NGRAT indicative of the shift position of the transmission are updated at a step S65, followed by terminating the present routine.

The volumetric efficiency correction is carried out by the following reason: During the lean-burn control, the effect of engine cooling by fuel decreases to lower the charging efficiency. Therefore, if the basic value of the fuel injection amount TI is multiplied by the lean-burn correction coefficient KLSAF, the resulting or controlled air-fuel ratio deviates from a desired value. That is, the TI map is set such that the controlled air-fuel ratio becomes equal to the stoichiometric value, and therefore during the lean-burn control, the KLSAF value is corrected to a smaller value. The modified correction coefficient KLSAFM is determined with this correction and the above-mentioned decrease of the engine-cooling effect taken into consideration.

NGR appearing at the step S65 represents the shift position parameter (NGR=1 to 5) employed when the vehicle is provided with a manual transmission, while NGRAT the shift position parameter (NGRAT=1 to 4) employed when the vehicle is provided with an automatic transmission.

Figure 6A:
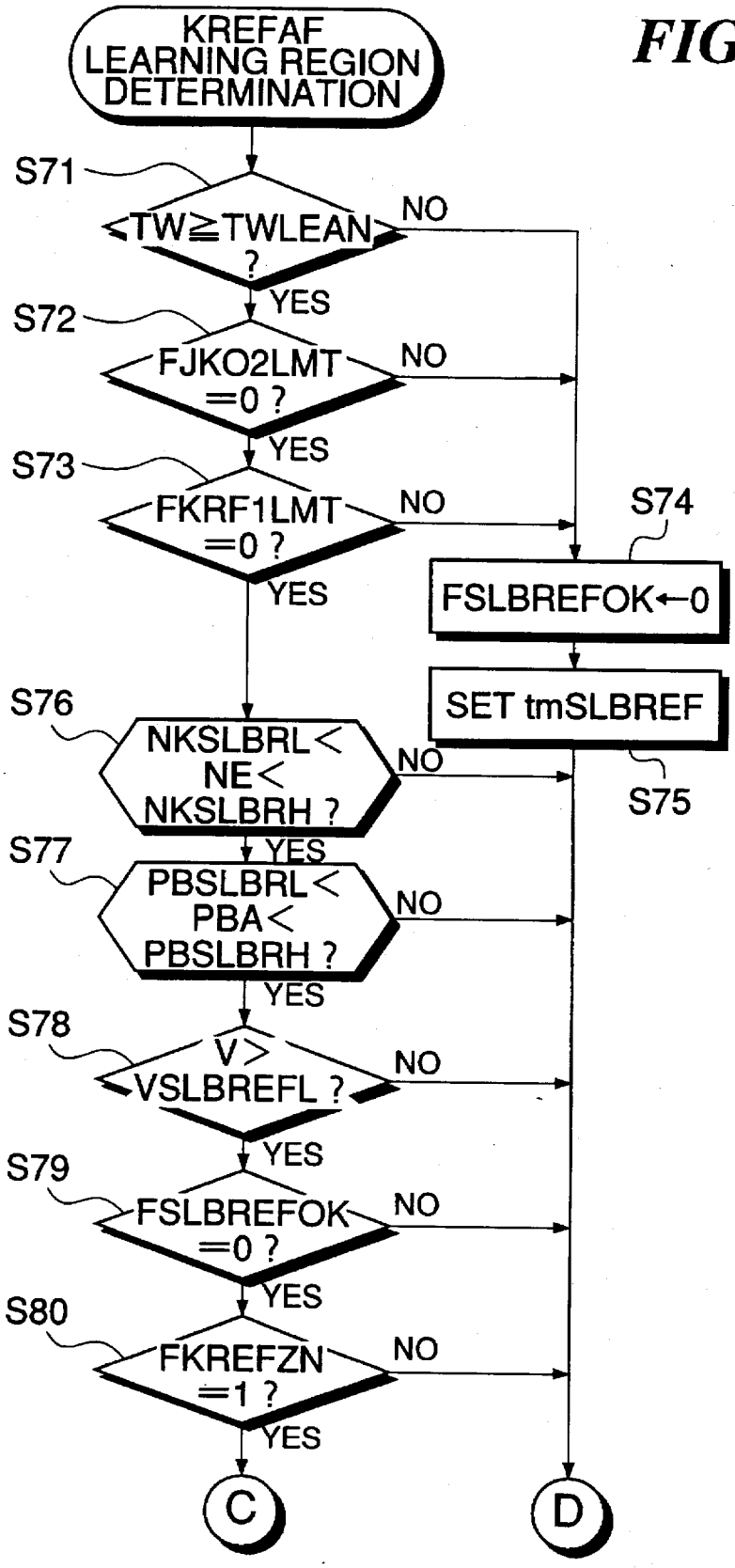
FIG. 6A is a flowchart showing a subroutine for determining a lean control learned value (KREFAF)-calculating region, which is executed at a step S35 in FIG. 4A.
Figure 6B:
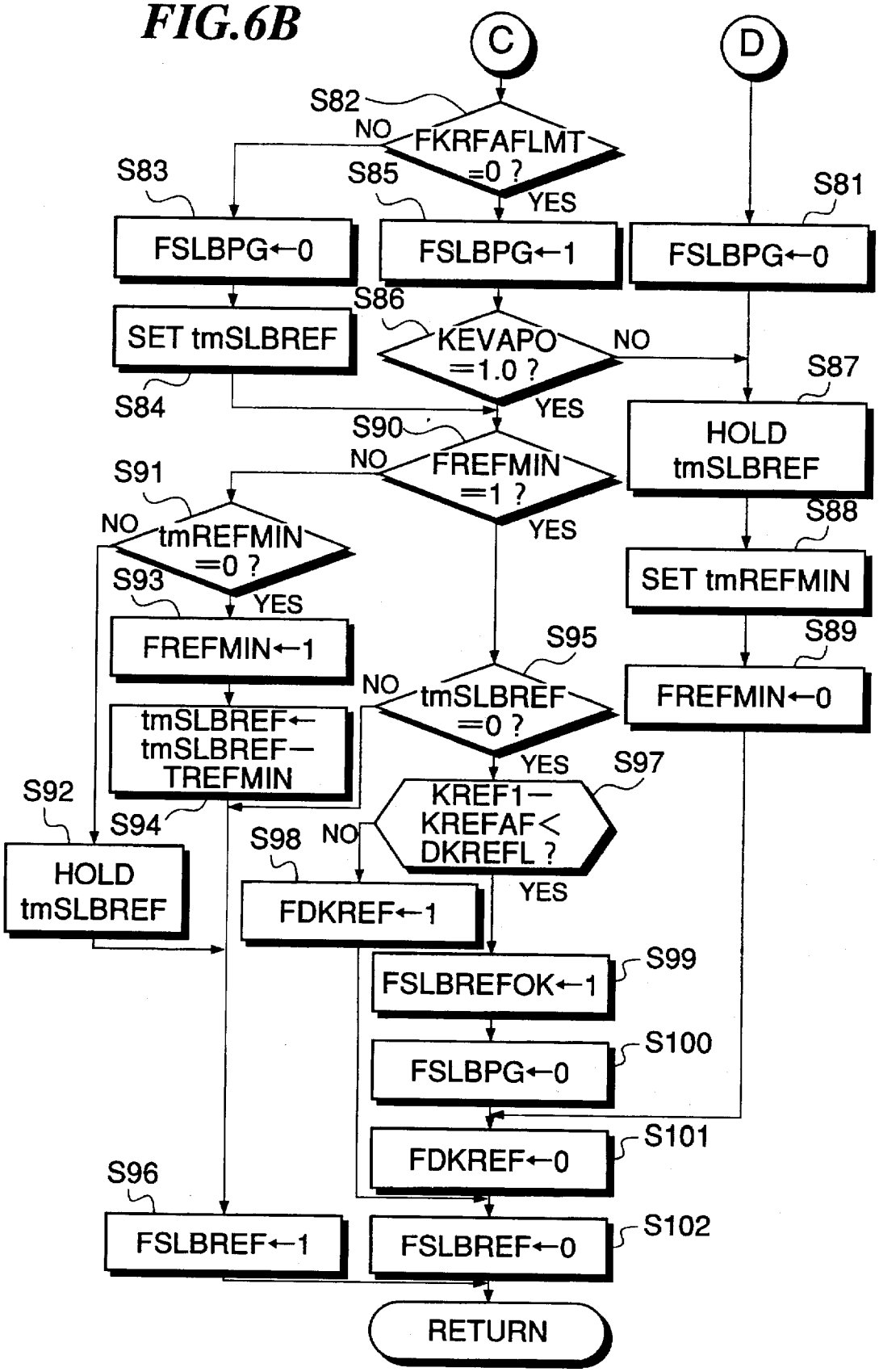
FIG. 6B is a continued part of the FIG. 6A flowchart.

FIGS. 6A and 6B show a subroutine for carrying out the KREFAF learning region-determining processing, which is executed at the step S35 in FIG. 4A.

First, at a step S71, it is determined whether or not the engine coolant temperature TW is higher than a predetermined value TWLEAN (e.g. 75° C.), which means that warming-up of the engine has been completed. If TW≧TWLEAN holds, then it is determined at a step S72 Whether or not a held state flag FJKO2LMT is set to "0". The held state flag FJKO2LMT is set to "1" to indicate that the air-fuel ratio correction coefficient KO2 has been held at an upper limit value or a lower limit value over a predetermined time period or more. If FJKO2LMT=0 holds, then it is determined at a step S73 whether or not a KREF1 held state flag FKRF1LMT is set to "0". The KREF1 held state flag FKRF1LMT is set to "0" to indicate that the off-idling learned value KREF1 has been held at an upper limit value or a lower limit value over a predetermined time period or more.

If any of the answers to the questions of the steps S71 to S73 is negative (NO), it is determined that the engine is not operating in the learning region, followed by the program proceeding to a step S74. At the step S74, the learning completion flag FSLBREFOK is set to "0", and the down-counting timer tmSLBREF is set to the predetermined learning time period TSLBREF and started at a step S75. Then, a purge cut-requiring flag FSLBPG which, when set to "1", indicates that purge cut is required (purge control valve 32 is to be closed), is set to "0" at a step S81 in FIG. 6B. Then, down-counting of the timer tmSLBREF set at the step S75 is stopped at a step S87, and a down-counting timer tmREFMIN is set to a minimum learning time period TREFMIN and started at a step S88. Then, a minimum learning time flag FREFMIN is set to "0" at a step S89, followed by the program proceeding to a step S101. The minimum learning time flag FREFMIN is set to "1" to indicate that the learning of the KREFAF value has been executed over the minimum learning time period TREFMIN.

At the step S101, the erroneous learning flag FDKREF is set to "0", and the learning zone flag FSLBREF is set to "0" at a step S102, followed by terminating the present routine.

On the other hand, if the answers to the questions of the steps S71 to S73 are all affirmative (YES), it is determined at a step S76 whether or not the engine rotational speed NE falls within a range between predetermined upper and lower limit values NKSLBRH and NKSLBRL (e.g. 3400 rpm and 1000 rpm, respectively). If NKSLBRL<NE<NKSLBRH holds, it is determined at a step S77 whether or not the intake pipe absolute pressure PBA falls within a range between predetermined upper and lower limit values PBSLBRH and PBSLBRL (e.g. 660 mmHg and 260 mmHg, respectively). If PBSLBRL<PBA<PBSLBRH holds, it is determined at a step S78 whether or not the vehicle speed V is higher than a predetermined value VSLBREFL (e.g. 30 km/h). If any of the answers to the questions of the steps S76 to S78 is negative (NO), i.e. if any of the engine rotational speed NE, the intake pipe absolute pressure PBA, or the vehicle speed V does not satisfy a predetermined condition, it is determined that the engine is not in the learning region, followed by the program proceeding to the step S81.

On the other hand, if V>VSLBREFL holds at the step S78, it is determined at a step S79 whether or not the learning completion flag FSLBREFOK which, when set to "1", indicates that calculation (learning) of the lean control learned value KREFAF has been completed, is set to "0". If FSLBREFOK=0 holds, it is determined at a step S80 whether or not the KO2 learning region flag FKREFZN (see the steps S13 and S14 in FIG. 2) is set to "1". If FSLBREFOK=1 or FKREFZN=0 holds, the program proceeds to a step S81, whereas if FSLBREFOK=0 and at the same time FKREFZN=1 hold, then it is determined at a step S82 in FIG. 6B whether or not a KREFAF held state flag FKRFAFLMT is set to "0". The KREFAF held state flag FKRFAFLMT is set to "1" to indicate that the lean control learned value KREFAF has been held at an upper limit value or a lower limit value over a predetermined time period or more.

In the first loop of execution of the step S82, FKRFAFLMT=0 holds, and then the program proceeds to a step S85, wherein the purge cut-requiring flag FSLBPG is set to "1" to execute purge cutting. Then, it is determined at a step S86 whether or not the evaporative fuel-dependent coefficient KEVAPO is equal to 1.0. If the KEVAPO<1.0 holds, which means that the influence of purging remains, the program proceeds to the step S87, whereas if KEVAPO=1.0 holds, the program proceeds to a step S90. If FKRFAFLMT=1 holds during calculation of the learned value KRERAF, the purge cut-requiring flag FSLBPG is set to "0" at a step S83, and then the down-counting timer tmSLBREF is again set to the predetermined learning time period TSLBREF at a step S84, followed by the program proceeding to the step S90.

At the step S90, it is determined whether or not the minimum learning time flag FREFMIN is set to "1". In the first loop of execution of the step S90, FREFMIN=0 holds, and then the program proceeds to a step S91, wherein it is determined whether or not the count value of the timer tmREFMIN set at the step S88 is equal to "0". While tmREFMIN>0 holds, down-counting of the timer tmSLBREF set at the step S75 or S84 is stopped at a step S92. Then, the KREFAF learning region flag FSLBREF is set to "1", and calculation of the learned value KREFAF is permitted at a step S96, followed by terminating the present routine.

When the minimum learning time period TREFMIN has elapsed after the start of learning, the count value of the timer tmREFMIN becomes zero, and then the program proceeds from the step S91 to a step S93, wherein the minimum learning time flag FREFMIN is set to "1", and then the minimum learning time period-is subtracted from the count value of the timer tmSLBREF at a step S94, followed by the program proceeding to the step S96.

If FREFMIN=1 holds at the step S93, the answer to the question of the step S90 becomes affirmative (YES), and then the program proceeds to a step S95, wherein it is determined whether or not the count value of the timer tmSLBREF is equal to "0". While tmSLBREF>0 holds, the program proceeds to the step S96, wherein calculation of the learned value KREFAF is continued. On the other hand, if tmSLBREF=0 holds, it is determined whether or not the difference (KREF1—KREFAF) between the off-idling learned value KREF1 and the lean control learned value KREFAF is smaller than a second predetermined difference DKREFL (e.g. 0.008) which is smaller than the first predetermined difference DKREFH (see the step S21 in FIG. 2), at a step S97. If (KREF1−KREFAF)≧DKREFL holds, it is determined that the off-idling learned value KREF1 is not proper (erroneously learned), and the erroneous learning flag FDKREF is set to "1" at a step S98. Then, the KREFAF learning region flag FSLBREF is set to "0" at a step S102, followed by terminating the present routine. The erroneous learning flag FDKREF is referred to at the step S20 in FIG. 2.

If (KREF1−KREFAF)<DKREFL holds at the step S97, the learning completion flag FSLBREFOK is set to "1" at a step S99, and then the purge cut-requiring flag FLSBPG is set to "0" at a step S100, followed by the program proceeding to the step S101.

If the learning completion flag FSLBREFOK is set to "1" at the step S99, the lean control learned value KREFAF is not learned as a rule, due to the execution of the step S79. However, by the execution of the steps S20 to S23 in FIG. 2, if the difference (KREF1−KREFAF) exceeds the first predetermined difference DKREFH, the learning completion flag FSLBREFOK is reset to "0", to thereby permit the KREFAF value to be learned again. As a result, the lean control learned value KREFAF can be updated to a proper value when the KREFAF value undergoes a deviation from the optimal value ascribable to the influence of purging or a change in the altitude, to thereby prevent degradation of the fuel consumption and the drivability.

Further, if it is determined at the step S97 that the difference (KREF1−KREFAF) obtained immediately after the calculation of the KREFAF value exceeds the second predetermined difference DKREFL, the erroneous learning flag FDKREF is set to "1" at the step S98, so that execution of the steps S21 et seq. in FIG. 2 is inhibited until the KREF1 value is updated to a proper value. As a result, the re-learning of the KREFAF value using the improper KREF1 value can be prevented.

Figure 7A:
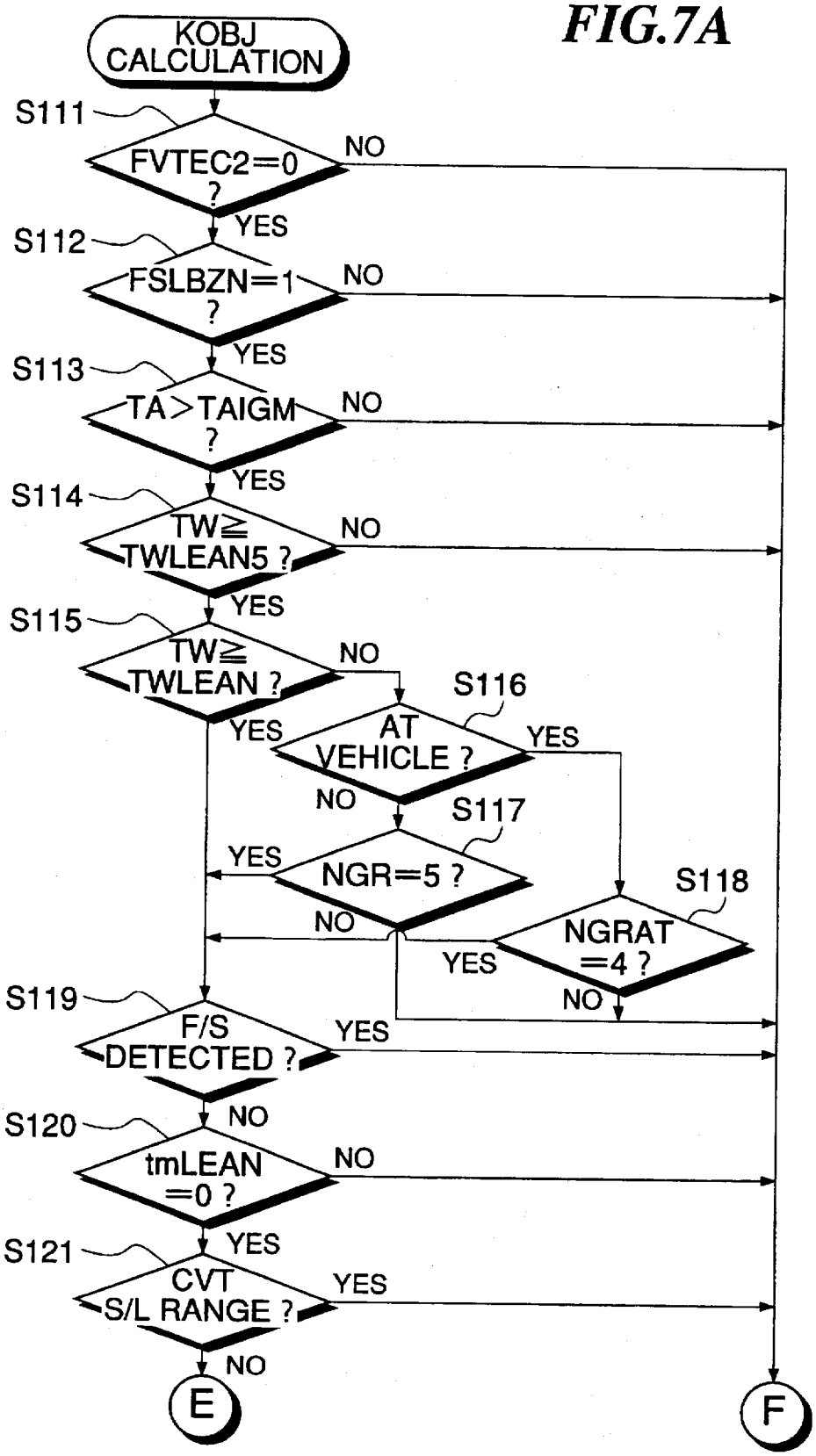
FIG. 7A is a flowchart showing a subroutine for calculating a desired air-fuel ratio KOBJ during execution of the lean-burn control, which is executed at a step S53 in FIG. 4B.
Figure 7C:
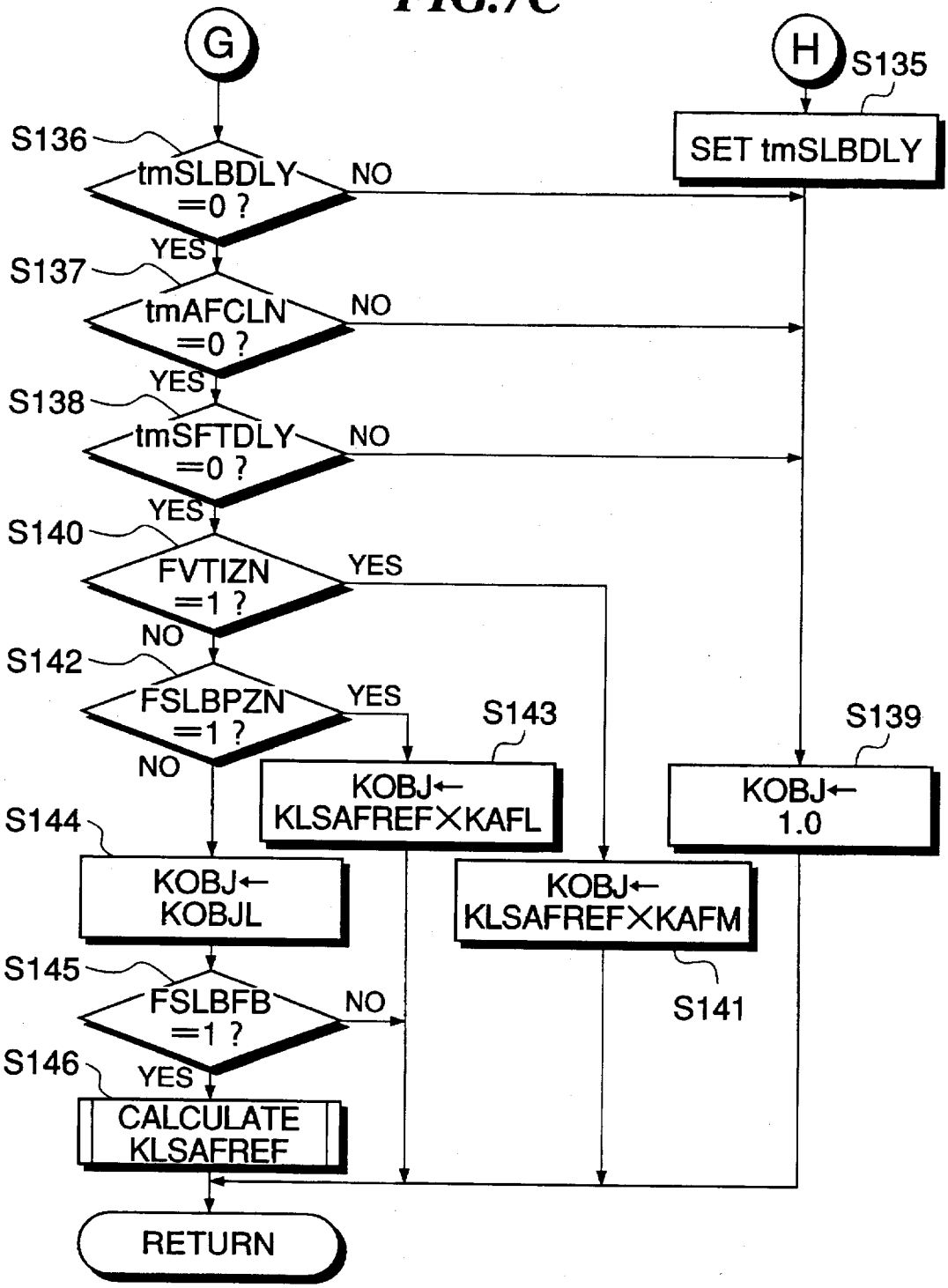
FIG. 7C is a continued part of the FIG. 7B flowchart.

FIGS. 7A to 7C show a subroutine for executing the KOBJ calculation, which is executed at the step S53 in FIG. 4B.

First, at a step S111, it is determined whether or not a high-speed valve timing flag FVTEC2 which, when set to "1", indicates that the engine is operating at the high-speed valve timing, is set to "0". If FVTEC2=0 holds, it is determined at a step S112 whether or not the SLB region flag FSLBZN is set to "1". If FSLBZN=1 holds, which means that the engine is operating in the SLB region, it is determined at a step S113 whether or not the intake air temperature TA is higher than a predetermined value TAIGM (e.g. −9° C.). If TA>TAIGM holds, it is determined at a step S114 whether or not the engine coolant temperature TW is equal to or higher than a predetermined value TWLEAN5 (e.g. 70° C.). If any of the answers to the questions of the steps S111 to S114 is negative (NO), it is determined that the lean-burn control should not be executed. Then, a down-counting timer tmSLBDLY is set to a predetermined time period TSLBDLY and started at a step S135, and the desired air-fuel ratio KOBJ is set to 1.0 at a step S139, followed by terminating the present routine.

If TW≧TWLEAN5 holds at the step S114, it is determined at a step S115 whether or not the engine coolant temperature TW is equal to or higher than a predetermined value TWLEAN (>TWLEAN5). If TW≧TWLEAN holds, the program jumps to a step S119. On the other hand, if TW<TWLEAN holds, it is determined at a step S116 whether or not the vehicle is equipped with an automatic transmission (hereinafter referred to as "the AT vehicle"). If the vehicle is not the AT vehicle, i.e. if the vehicle is equipped with a manual transmission (hereinafter referred to as "the MT vehicle"), it is determined at a step S117 whether or not the shift position is a 5th speed position. If it is the 5th speed position, the program proceeds to the step S119, whereas if it is not the 5th speed position, the program proceeds to the step S135. If the vehicle is the AT vehicle, it is determined at a step S118 whether or not the shift position is a 4th speed position. If it is the 4th speed position, the program proceeds to the step S119, whereas if it is not the 4th speed position, the program proceeds to the step S135.

At the step S119, it is determined whether or not abnormality of any of the engine rotational speed sensor (CRK sensor) 11, the PBA sensor 8, etc. has been detected. If abnormality has been detected, the program proceeds to the step S135. On the other hand, if no abnormality has been detected, it is determined at a step S120 whether or not the count value of the timer tmLEAN set at the step S32 in FIG. 4A is equal to "0". Immediately after completion of the cranking mode, tmLEAN>0 holds, and then the program proceeds to the step S135. On the other hand, if tmLEAN=0 holds, the program proceeds to a step S121, wherein it is determined whether or not the vehicle employs a continuously variable speed transmission (CVT) and at the same time the CVT has selected a sports mode, in which a shift position lower in reduction gear ratio than an ordinary shift position is set, or a low gear position. If the answer is affirmative (YES), the program proceeds to the step S135, whereas if the answer is negative (NO), it is determined at a step S122 in FIG. 7B whether or not the vehicle is the AT vehicle.

If the vehicle is not the AT vehicle, i.e. if it is the MT vehicle, it is determined at a step S124 whether or not the shift position NGR is on a higher speed side with respect to a predetermined shift position NGRL. If NGR≦NGRL holds, the program immediately proceeds to the step S135, whereas if NGR NGRL holds, it is determined at a step S126 whether or not the vehicle speed V is higher than a predetermined value VNGRL. If V≦VNGRL holds, the program proceeds to the step S135, whereas if V>VNGRL holds, the program proceeds to a step S127.

On the other hand, if the vehicle is the AT vehicle, the program proceeds from the step S122 to a step S123, wherein it is determined whether or not the shift position NGRAT is on a higher speed side with respect to a predetermined shift position NGRATL. If NGRAT≦NGRATL holds, the program proceeds to the step S135, whereas if NGRAT>NGRATL holds, it is determined at a step S125 whether or not a parameter DOUT for controlling engagement pressure of a lock-up clutch of the automatic transmission is larger than a predetermined value DLCSLBH. The DOUT value represents a control duty ratio of the electromagnetic valve, and the larger the DOUT value, the higher the engagement pressure. If DOUT≦DLCSLBH holds, the program proceeds to the step S126, whereas if DOUT>DLCSLBH holds, the program immediately proceeds to a step S127.

By the execution of the above steps S121 to S126, execution of the lean-burn control is inhibited depending on the shift position or the vehicle speed (or the engaging state of the lock-up clutch).

At the step S127, it is determined whether or not the evaporative fuel-dependent correction coefficient KEVAPO is larger than a predetermined value KEVASLB. If KEVAPO>KEVASLB holds, it is determined at a step S128 whether or not the learning completion flag FSLBREFOK is set to "1". If FSLREFOK=1 holds, then it is determined at a step S129 whether or not a lean-burn inhibition flag FMFLBOK which, when set to "0", indicates that the lean-burn control is being inhibited, is set to "1". If FMFLBOK=1 holds, it is determined at a step S130 whether or not a WOT flag FWOT is set to "1". The WOT flag FWOT is set to "1" to indicate that the engine is operating in a WOT region where the throttle valve is almost fully opened.

If KEVAPO≦KEVASLB holds, which means that influence of evaporative fuel is large, or if FSLBREFOK=0 holds, which means that learning of the lean control learned value KREFAF has not been completed, or if FMFLBOK=0 holds, which means that the lean-burn control is inhibited due to misfire-detection, or if FWOT=1 holds, which means that the engine is in the WOT region, the program proceeds to the step S135, whereby the lean-burn control is inhibited.

Figure 8:
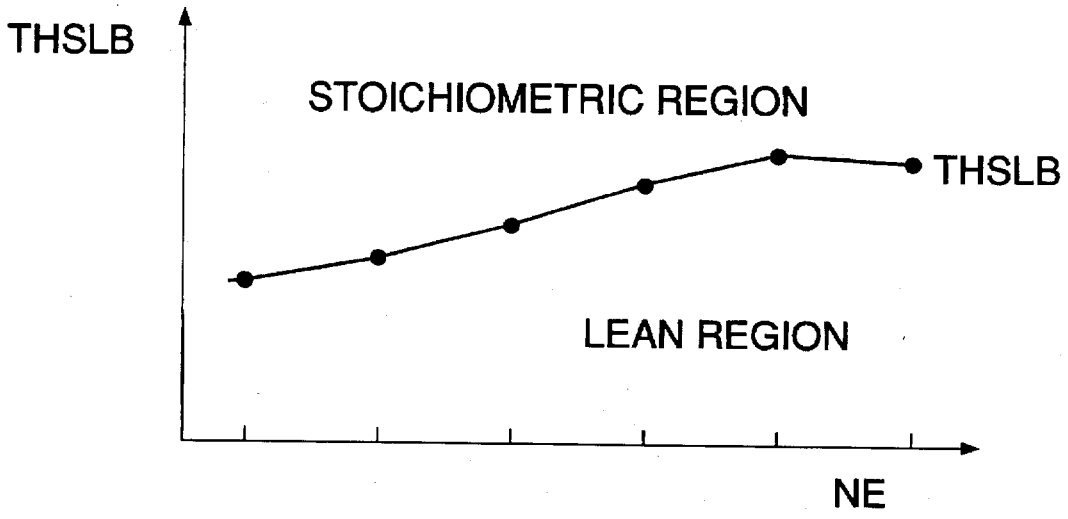
FIG. 8 shows a table for determining a lean-burn control upper limit value THSLB of throttle valve opening.

If the answer to the question of the step S130 is negative (NO), i.e. if FWOT=0 holds, a THSLB table, shown in FIG. 8, is retrieved based on the engine rotational speed NE, to thereby determine a lean-burn control upper limit value THSLB of the throttle valve opening θTH, at a step S131. Then, it is determined at a step S132 whether or not the detected throttle valve opening θTH is smaller than the upper limit value THSLB, and if θTH<THSLB holds, it is determined at a step S133 whether or not a rate of variation DTH (θTH(N)-θTH(N−1)) in the throttle valve opening θTH is smaller than a predetermined rate of variation DTHKCR. If DTH<DTHKCCR holds, it is determined at a step S134 whether or not a rate of variation DPB (PBA(N) -PBA(N−1)) in the intake pipe absolute pressure PBA is smaller than a predetermined rate of variation DPBKCR. If any of the answers to the questions of the steps S132 to S134 is negative (NO), the program proceeds to the step S135, whereby the lean-burn control is inhibited.

On the other hand, if the answers to the questions at the steps S132 to S134 are all affirmative (YES), it is determined at a step S136 in FIG. 7C whether or not the count value of the timer tmSLBDLY set at the step S135 is equal to "0". If tmSLBDLY>0 holds, the program proceeds to the step S139, wherein the desired air-fuel ratio KOBJ is set to 1.0. On the other hand, if tmSLBDLY=0 holds, it is determined at a step S137 whether or not the count value of the timer tmAFCLN set at the step S55 in FIG. 4B is equal to "0". If tmAFCLN>0 holds, which means that a predetermined time period TAFCLN has not elapsed after completion of the fuel cut, the program proceeds to the step S139. On the other hand, if tmAFCLN=0 holds, it is determined at a step S138 whether or not the count value of a timer tmSFTDLY is equal to "0". The timer tmSFTDLY is set when shifting-down of the transmission has been detected in the processing of the SLB shift change determination executed at the step S36 in FIG. 4A.

If tmSFTDLY>0 holds, which means that the predetermined time period TSFTDLY has not elapsed after detection of the shifting-down, the program proceeds to the step S139. On the other hand, if tmSFTDLY=0 holds, it is determined at a step S140 whether or not an intermediate-speed valve timing flag FVT1ZN is set to "1". The flag FVT1ZN is set to "1" to indicate that the intermediate-speed valve timing has been selected. If FVT1ZN=1 holds, the desired air-fuel ratio KOBJ is calculated at a step S141, by the use of the following equation (6), followed by terminating the present routine:

$$KOBJ=KLSAFREF\times KAFM \quad (6)$$

where KLSAFREF represents a learned value of the lean-burn correction coefficient KLSAF which is calculated during the air-fuel ratio feedback control at a step S146, referred to hereinafter. KAFM represents a correction coefficient suitable for the intermediate-speed valve timing, which is set such that the KOBJ value determined by the equation (6) assumes a value which satisfies a relationship of A/F=18 for example.

If FVT1ZN=0 holds at the step S140, i.e. if the low-speed valve timing has been selected, then it is determined at a step S142 whether or not the SLB high-load region flag FSLBPZN is set to "1". If FSLBPZN=1 holds, which means that the engine is operating in the high-load region within the SLB region, the desired air-fuel ratio KOBJ is calculated at a step S143, by the use of the following equation (7), followed by terminating the present routine:

$$KOBJ=KLSAFREF\times KAFL \quad (7)$$

where KAFL represents a correction coefficient suitable for high-load region, which is smaller than the correction coefficient KAFM suitable for the intermediate-speed valve timing. The KAFL value is set such that the KOBJ value determined by the equation (7) assumes a value which satisfies a relationship of A/F=20.5 for example.

If FSLBPZN=0 holds at the step S142, the desired air-fuel ratio KOBJ is set to a predetermined lower limit value KOBJL at a step S144, and then it is determined at a step S145 whether or not the SLB F/B flag FSLBFB is set to "1". If FSLBFB=0 holds, the program is immediately terminated, whereas if FSLBFB=1 holds, the learned value KLSAFREF of the lean-burn correction coefficient KLSAF is calculated at the step S146, by the use of the following equation (8), followed by terminating the present routine:

$$KLSAFREF=KLSCRF\times KLSAF(N)/A+(A-KLSCRF)\times KLSAFREF(N-1)/A \quad (8)$$

where KLSCRF represents an averaging coefficient set to a value between 1 and the A value.

Figure 10:
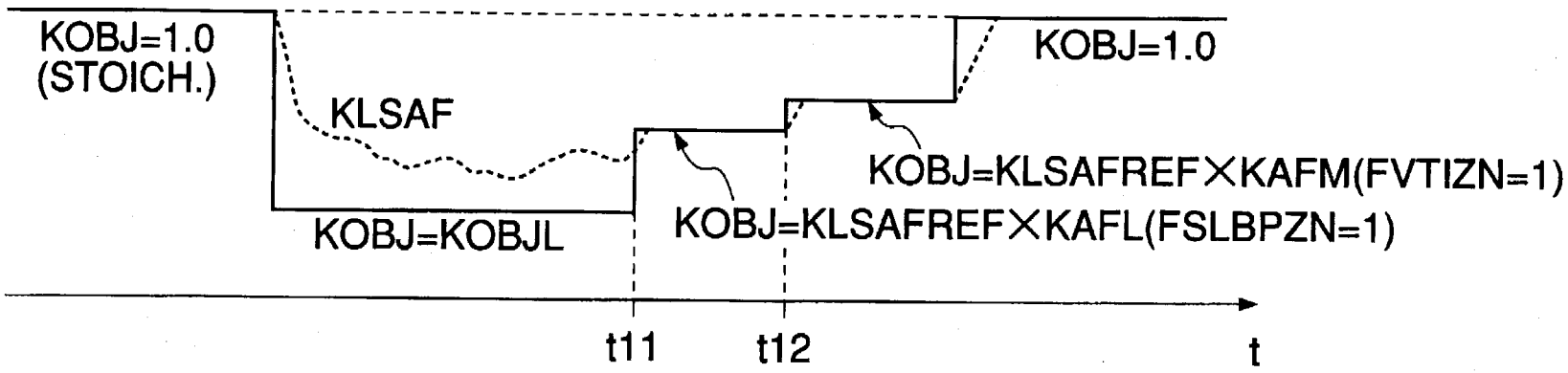
FIG. 10 is a timing chart showing changes in the KOBJ value.

FIGS. 9 and 10 show timing charts useful in explaining an outline of the above described processing.

Referring first to FIG. 9, when the engine operating condition enters the SLB region at a time point t1 (FIG. 4A, step S46), the SLB region flag FSLBZN is set to "1" (FIG. 7A, step S112; FIG. 9C) and at the same time the SLB execution delay timer tmSLBDLY starts down-counting (FIG. 7C, step S135; FIG. 9B). At a time point t2 when the count value of the timer tmSLBDLY becomes equal to 0 (FIG. 7C, step S136; FIG. 9B), the SLB execution flag FLSB is set to "1" (FIG. 4B, steps S60, S62; FIG. 9D), so that the lean-burn control is actually started. At this time, the desired air-fuel ratio KOBJ is stepwise changed to the smaller value KOBJL (FIG. 7C, step S114; FIG. 9A), but the lean-burn correction coefficient KLSAF is progressively lowered by the limit-checking (FIG. 4B, step S59; FIG. 9A).

At a time point t3 when conditions for executing the feedback control based on the variation rate DMSSLB in the engine rotational speed become satisfied, the SLB F/B flag FLSBFB is set to "1" (FIG. 7C, step S145; FIG. 9E). At a time point t4 when the engine operating condition shifts to the high-load region within the SLB region (FIG. 7C, step S142; FIG. 9F), the desired air-fuel ratio KOBJ is updated in the enriching direction (FIG. 7C, step S144; FIG. 9A), and the KLSAF value progressively increases to the updated KOBJ value (FIG. 4B, step S59; FIG. 9A). At this time, the feedback control based on the rate of variation DMSSLB in the engine rotational speed is temporarily stopped (FIG. 9E).

At a time point t5 when the engine operating condition shifts from the SLB region to the outside thereof, the SLB v flag FSLBZN, the SLB F/B flag FSLBFB, and the SLB high-load region flag FSLBPZN are reset to "0" (FIG. 4A, step S46; FIG. 4B, step S59; FIGS. 9C, 9E, 9F), and the KOBJ value is returned to 1.0 (FIG. 7A, step S112; FIG. 7C, step S139; FIG. 9A). The KLSAF value is controlled so as to progressively increase to 1.0 (FIG. 4B, step S59 and FIG. 9A), and at a time point t6 when the KLSAF value reaches 1.0, the SLB flag FSLB is reset to "0" (FIG. 4B, steps S60, S61; FIG. 9D).

Next, how the KOBJ value is set in the SLB high-load region will be described in detail with reference to FIG. 10.

First, at a time point t11, the SLB high-load region flag FSLBPZN is set to "1" (FVT1ZN=0) (FIG. 7C, step S142), and the KOBJ value is shifted to a richer value calculated by the use of the equation (7) (FIG. 7C, step S143). When the intermediate-speed valve timing flag FVT1ZN is set to "1" (FIG. 7C, step S140), the KOBJ value is changed to a richer value calculated by the equation (6) (FIG. 7C, steps S140 and S141). Thus, when the engine is operating in the high-load SLB region within the SLB region, the KOBJ value is set to a richer value than a value assumed when the engine is operating outside the high-load region. Further, when the intermediate-speed valve timing is selected, the KOBJ value is set to a richer value than a value assumed when the low-speed valve timing is selected.

As described above in detail, when the engine is operating in predetermined conditions during the air-fuel ratio feedback control, first and second learned values are calculated. Lean-burn control is executed by the use of the first learned value. When the difference between the first and second values is larger than a predetermined re-learning determination threshold value, the first value is learned again. As a result, an optimal learned value can be obtained regardless of the influence of purging and change in the altitude, to thereby enable execution of the lean-burn control using the optimal learned value.

What is claimed is:

1. An air-fuel ratio control system for an internal combustion engine having an exhaust system, comprising:

air-fuel ratio-detecting means arranged in said exhaust system, for detecting an air-fuel ratio of exhaust gases emitted from said engine;

operating condition-detecting means for detecting operating conditions of said engine;

feedback control means for controlling an air-fuel ratio of an air-fuel mixture to be supplied to said engine to a desired air-fuel ratio in a feedback manner responsive to an output from said air-fuel ratio-detecting means;

first learned value-calculating means for calculating a first learned value for correcting said desired air-fuel ratio, based on an output from said feedback control means, when said engine is detected to be in a first predetermined operating condition by said operating condition-detecting means;

second learned value-calculating means for calculating a second learned value for correcting said desired air-fuel ratio, based on said output from said feedback control means, when said engine is detected to be in a second predetermined engine operating condition by said operating condition-detecting means;

leaning control means for controlling said air-fuel ratio of said air-fuel mixture to a value leaner than a stoichiometric value, by using said first learned value; and re-learning means for re-learning said first learned value when a difference between said first learned value and said second learned value is larger than a predetermined re-learning-determining threshold value.

2. An air-fuel ratio control system as claimed in claim 1, wherein said first predetermined operating condition of said engine is a condition after completion of warming-up of said engine.

3. An air-fuel ratio control system as claimed in claim 1 or 2, wherein said second predetermined operating condition of said engine is a condition other than idling of said engine, said second learned value-calculating means calculating said second learned value before completion of calculation of said first learned value by said first learned value-calculating means.

4. An air-fuel ratio control system as claimed in claim 1 or 2, including inhibiting means for inhibiting re-learning of said first learned value when said difference is larger than a predetermined inhibition-determining threshold value immediately after completion of learning of said first learned value.

5. An air-fuel ratio control system as claimed in claim 3, including inhibiting means for inhibiting re-learning of said first learned value when said difference is larger than a predetermined inhibition-determining threshold value immediately after completion of learning of said first learned value.

* * * * *